US006244739B1

(12) United States Patent
Jarchau et al.

(10) Patent No.: US 6,244,739 B1
(45) Date of Patent: Jun. 12, 2001

(54) VALVE MEMBERS FOR A HOMOGENIZATION VALVE

(75) Inventors: Michael Jarchau, Lubeck (DE); Harald O. Korstvedt, Harvard; Blaine Potter, Sharon, both of MA (US)

(73) Assignee: APV North America, Inc., Wilmington, MA (US)

( * ) Notice: Subject to any disclaimer, the term of this patent is extended or adjusted under 35 U.S.C. 154(b) by 0 days.

(21) Appl. No.: 09/350,504

(22) Filed: Jul. 9, 1999

(51) Int. Cl.[7] ..... B01F 5/06

(52) U.S. Cl. ..... 366/176.2; 128/42; 137/625.3; 251/63.6

(58) Field of Search ..... 366/176.1, 176.2, 366/340; 138/42, 43; 251/63.5, 63.6, 121, 127; 137/625.3

(56) References Cited

U.S. PATENT DOCUMENTS

| | | | | |
|---|---|---|---|---|
| 1,925,787 | * | 9/1933 | Brooks | 366/176.2 |
| 2,504,678 | * | 4/1950 | Gardner | 366/340 |
| 2,882,025 | * | 4/1959 | Loo | 366/340 |
| 3,601,157 | | 8/1971 | Milleville et al. | 137/630.14 |
| 3,631,891 | | 1/1972 | Brumm | 137/625.3 |
| 3,746,041 | | 7/1973 | Friedland | 137/599 |
| 3,894,716 | | 7/1975 | Barb | 251/127 |
| 3,920,044 | * | 11/1975 | Gruner | 138/43 |
| 3,995,664 | * | 12/1976 | Nelson | 138/43 |
| 4,004,613 | * | 1/1977 | Purton et al. | 138/42 |
| 4,011,287 | | 3/1977 | Marley | 261/64 R |
| 4,060,099 | * | 11/1977 | Bates, Jr. | 138/43 |
| 4,125,129 | | 11/1978 | Baumann | 137/625.3 |
| 4,199,267 | * | 4/1980 | Hendrikz | 366/176.2 |
| 4,316,478 | * | 2/1982 | Gongwer | 137/625.3 |
| 4,348,116 | | 9/1982 | Bordas | 366/340 |
| 4,352,573 | | 10/1982 | Pandolfe | 366/176 |
| 4,429,714 | | 2/1984 | Hughes et al. | 137/625.3 |
| 4,531,548 | | 7/1985 | Gottling et al. | 137/627.5 |
| 4,585,357 | * | 4/1986 | Ogata | 366/340 |
| 4,667,699 | | 5/1987 | Löliger | 138/31 |
| 4,860,993 | | 8/1989 | Goode | 251/127 |
| 4,938,450 | * | 7/1990 | Tripp et al. | 138/43 |
| 4,944,602 | | 7/1990 | Buschelberger | 366/337 |
| 4,952,067 | * | 8/1990 | Dallas | 366/340 |
| 5,018,703 | | 5/1991 | Goode | 251/127 |
| 5,113,908 | | 5/1992 | Steinke | 137/625.3 |
| 5,309,934 | | 5/1994 | Jaeger | 137/1 |
| 5,498,075 | * | 3/1996 | Jarchau et al. | 366/176.2 |
| 5,672,821 | | 9/1997 | Suzuki | 73/202 |
| 5,692,684 | | 12/1997 | Zurmühlen | 239/563 |
| 5,749,650 | | 5/1998 | Kinney et al. | 366/176.2 |
| 5,782,557 | | 7/1998 | Young | 366/176.2 |
| 5,887,971 | | 3/1999 | Gandini et al. | 366/176.2 |
| 5,899,564 | * | 5/1999 | Kinney et al. | 366/176.2 |

FOREIGN PATENT DOCUMENTS

WO 00/15327 3/2000 (WO) .

OTHER PUBLICATIONS

Leslie W. Phipps; "Effects of main flow reversal in a simple homogenizing valve"; Journal of Dairy Research; pp 525–528; Mar. 1978.

* cited by examiner

*Primary Examiner*—Tony G. Soohoo
(74) *Attorney, Agent, or Firm*—Hamilton, Brook, Smith & Reynolds, P.C.

(57) ABSTRACT

A homogenization valve includes a housing and stacked valve members within the housing. The valve members have central holes therethrough defining a high pressure volume. Each valve member includes a valve seat defining, with a valve surface, gaps through which fluid is expressed radially from an inside high pressure volume to the low pressure volume. The actuator acts on the valve members to control the width of the gaps. The valve member includes circumferentially spaced, compressible spacing elements to maintain the gap. The actuator controls substantially all of the gap widths by compressing the spacing elements. Annular springs are positioned within the high pressure volume in spring-grooves in the valve members to align adjoining pairs of valve members to maintain the stacked member configuration.

74 Claims, 5 Drawing Sheets

VALVE MEMBERS FOR A HOMOGENIZATION VALVE

RELATED APPLICATIONS

The present application is related to U.S. application Ser. No. 09/351,043 entitled "FORCE ABSORBING HOMOGENIZATION VALVE" by Michael Jarchau and Ser. No. 09/350,503 entitled "HOMOGENIZATION VALVE WITH OUTSIDE HIGH PRESSURE VOLUME" by Michael Jarchau, both applications being filed concurrently with the present application and incorporated herein in their entirety by this reference.

BACKGROUND OF THE INVENTION

Homogenization is the process of breaking down and blending components within a fluid. One familiar example is milk homogenization in which milk fat globules are broken-up and distributed into the bulk of the milk. Homogenization is also used to process other emulsions such as silicone oil and process dispersions such as pigments, antacids, and some paper coatings.

The most common device for performing homogenization is a homogenization valve. The emulsion or dispersion is introduced under high pressure into the valve, which functions as a flow restrictor to generate intense turbulence. The high pressure fluid is forced out through a usually narrow valve gap into a lower pressure environment.

Homogenization occurs in the region surrounding the valve gap. The fluid undergoes rapid acceleration coupled with extreme drops in pressure. Theories have suggested that both turbulence and cavitation in this region are the mechanisms that facilitate the homogenization.

Early homogenization valves had a single valve plate that was thrust against a valve seat by some, typically mechanical or hydraulic, actuating system. Milk, for example, was expressed through an annular aperture or valve slit between the valve and the valve seat.

While offering the advantage of a relatively simple construction, the early valves could not efficiently handle high milk flow rates. Homogenization occurs most efficiently with comparatively small valve gaps, which limits the milk flow rate for a given pressure. Thus, higher flow rates could only be achieved by increasing the diameter or size of a single homogenizing valve.

Newer homogenization valve designs have been more successful at accommodating high flow rates while maintaining near optimal valve gaps. Some of the best examples of these designs are disclosed in U.S. Pat. Nos. 4,352,573 and 4,383,769 to William D. Pandolfe and assigned to the instant assignee, the teachings of these patents being incorporated herein in their entirety by this reference. Multiple annular valve members are stacked one on top of the other. The central holes of the stacked members define a common, high pressure, chamber. Annular grooves are formed on the top and/or bottom surfaces of each valve member, concentric with the central hole. The grooves are in fluid communication with each other via axially directed circular ports that extend through the members, and together the grooves and ports define a second, low pressure, chamber. In each valve member, the wall between the central hole and the grooves is chamfered to provide knife edges. Each knife edge forms a valve seat spaced a small distance from an opposed valve surface on the adjacent valve member. In this design, higher flow rates are accommodated simply by adding more valve members to the stack.

SUMMARY OF THE INVENTION

Prior art systems have suffered from at least two deficiencies. First, maintaining an optimized distance between substantially all of the valve gaps has not been achieved. For example, as disclosed in the '769 patent, in situations where the valve surface and valve seat wear down due to extended use, the actuator flexes the top valve members to close only a desired number of valve gaps to maintain the pressure differential so that the fluid is properly homogenized. It would be preferable to adjust substantially all of the valve gaps to maintain a predetermined separational distance between the valve seat and valve surface.

Second, prior art valves have been prone to noise emissions. It has been found that the noise is attributable, at least in part, to the environment into which the homogenized fluid is expressed. More particularly, the prior valves have expressed the fluid into a relatively closed environment between the valve members. This has been found to cause chattering of the valve members which can damage the valve members, emit noise, and produce other deleterious effects in the operation of the valve.

In accordance with one aspect of the invention, a valve member for a stacked valve member homogenizing valve includes a valve seat to define a gap with an opposed valve surface. Fluid is expressed through the gap from a high pressure volume to a low pressure volume. A plurality of gaps are formed between the valve members when stacked on one another. Spacing elements between the valve members are compressed by an actuator to control the width of the gaps. The valve members preferably include circumferentially spaced, compressible spacing elements to maintain the gaps. A housing surrounds the stacked valve members. Preferably, the actuator controls substantially all of the gap widths by compressing the spacing elements.

The preferred valve member includes opposite faces. The first face includes the valve seat while the second face includes the valve surface to define respective valve gaps when valve members are stacked on one another.

In accordance with other aspects of the present invention, the spacing elements are integral to the valve member and are formed by removing portions of the valve member. Each valve member can include four spacing elements. The spacing elements can be formed from a first material such as stainless steel and the valve seats and valve surfaces can be formed from a second material such as tungsten-carbide. This configuration minimizes wear of the valve seat and surface while allowing compression of the spacing elements to maintain the valve gaps.

In accordance with yet another aspect of the present invention, annular springs are positioned within spring-grooves in the valve members to align adjoining pairs of valve members to maintain the stacked member configuration. Preferably, the springs are positioned in the high pressure volume. The ends of the springs can be bent and positioned in notches of adjacent valve members to maintain angular alignment of the valve members.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

Figure 1:
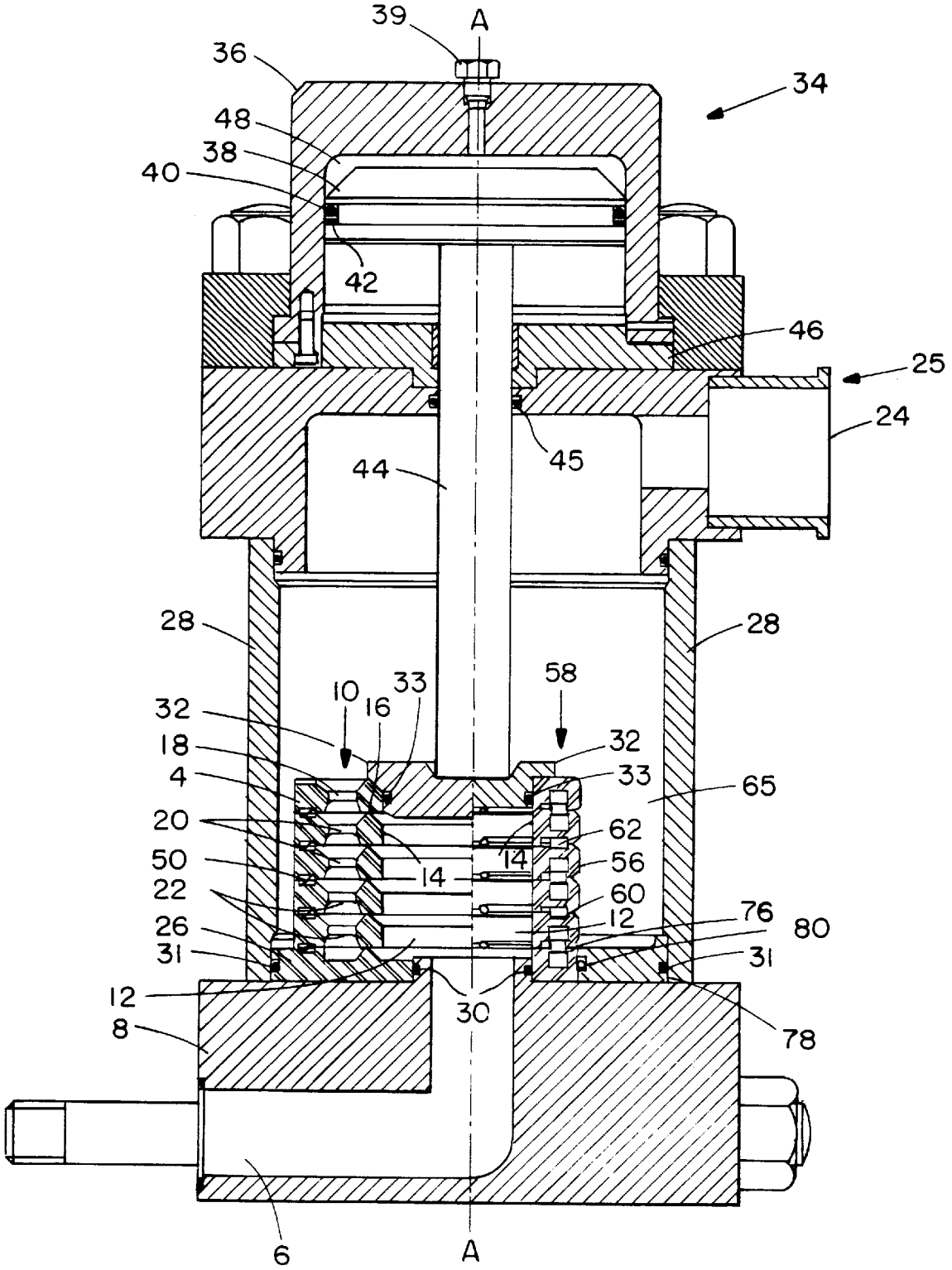
FIG. 1 is a cross sectional view of a homogenization valve illustrating prior art valve members on the left side of longitudinal axis A—A and inventive valve members in accordance with the present invention on the right side of the longitudinal axis A—A.

FIG. 1 is a cross sectional view of a primary valve assembly 2 for use in a homogenizing system (complete system not shown). The previous design of valve members is shown on the left side of longitudinal axis A—A while the inventive valve members of the present invention are illustrated on the right side.

Figure 2:
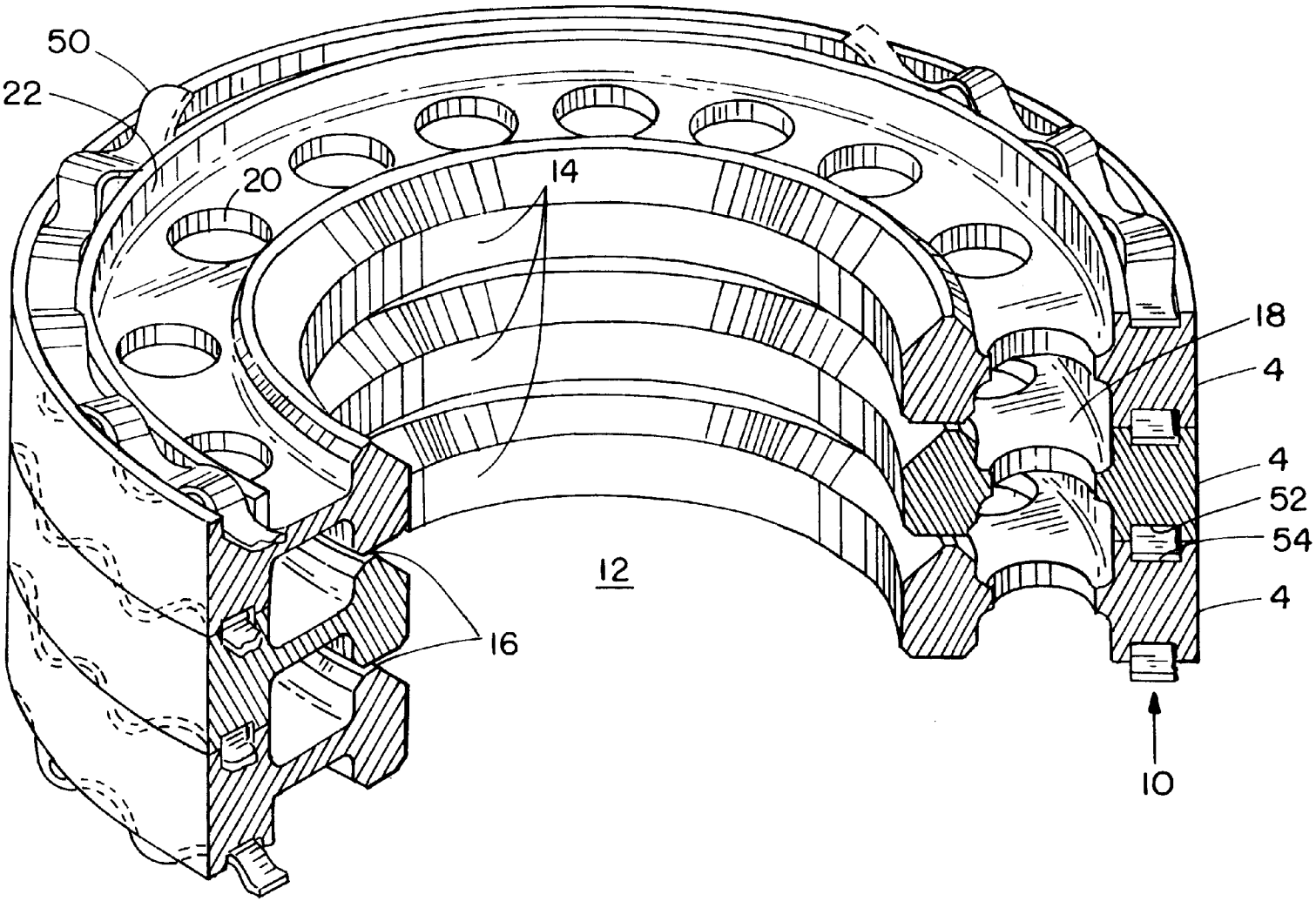
FIG. 2 PRIOR ART
FIG. 2 is a cross sectional isometric view of the prior art valve members shown in FIG. 1.

The prior art valve includes valve members 4 constructed according to the principles disclosed in the '769 patent, many of the details of these members being better understood with reference to FIG. 2.

With reference to both FIGS. 1 and 2, an inlet port 6, formed in an inlet flange 8, conveys a high pressure fluid to a valve member stack 10. The high pressure fluid is introduced into an inner chamber 12 defined by the central holes 14 formed through the generally annular valve members 4. The high pressure fluid is then expressed through valve gaps 16 into a low pressure chamber 18 that is defined by the axial ports 20 through the valve members 4 and the annular grooves 22 in the valve members 4. The fluid passing into the low pressure chamber 18 enters a discharge port 24 in a discharge flange assembly 25.

The stack 10 of valve members 4 is sealed against the inlet flange 8 via a base valve member 26 using o-ring 30. The base valve member 26 is sealed against the housing 28 via o-ring 31. This base valve member 26 is costly to manufacture because of its complex shape. The top-most valve member 4 engages a top valve plug 32 that seals across the inner chamber 12. An o-ring 33 provides a fluid seal between the top-most valve member 4 and the top valve plug 32. This top valve plug 32 is hydraulically or pneumatically urged by actuator assembly 34, which comprises an actuator body 36 surrounding an actuator piston 38 sealed via an o-ring 40 and a backup o-ring 42. A vent plug 39 is provided in the actuator body 36 to bleed air from the cavity 48.

The piston 38 is connected to the top plug 32 via an actuator rod 44. An actuator guide plate 46 sits between the actuator body 36 and the discharge flange assembly 25. A rod seal 45 provides a fluid seal between the actuator rod 44 and the discharge flange assembly 25. By varying the pressure of a hydraulic fluid or pneumatically in cavity 48 through a fluid port (not shown), the size of the valve gaps 16 may be modulated by inducing the axial flexing of the valve members 4. For example, as disclosed in the '769 patent, the downward force flexes the top valve members to close the desired number of valve gaps to adjust the pressure differential. This design has not been able to modulate substantially all of the gaps, which is desirable for optimal performance of the valve.

The base valve member 26 and other valve members 4 are aligned with respect to each other and maintained in the stack formation by serpentine valve springs 50 that are confined within cooperating spring-grooves 52, 54 formed in the otherwise flat peripheral rim surfaces of each valve member 4.

Figure 3:
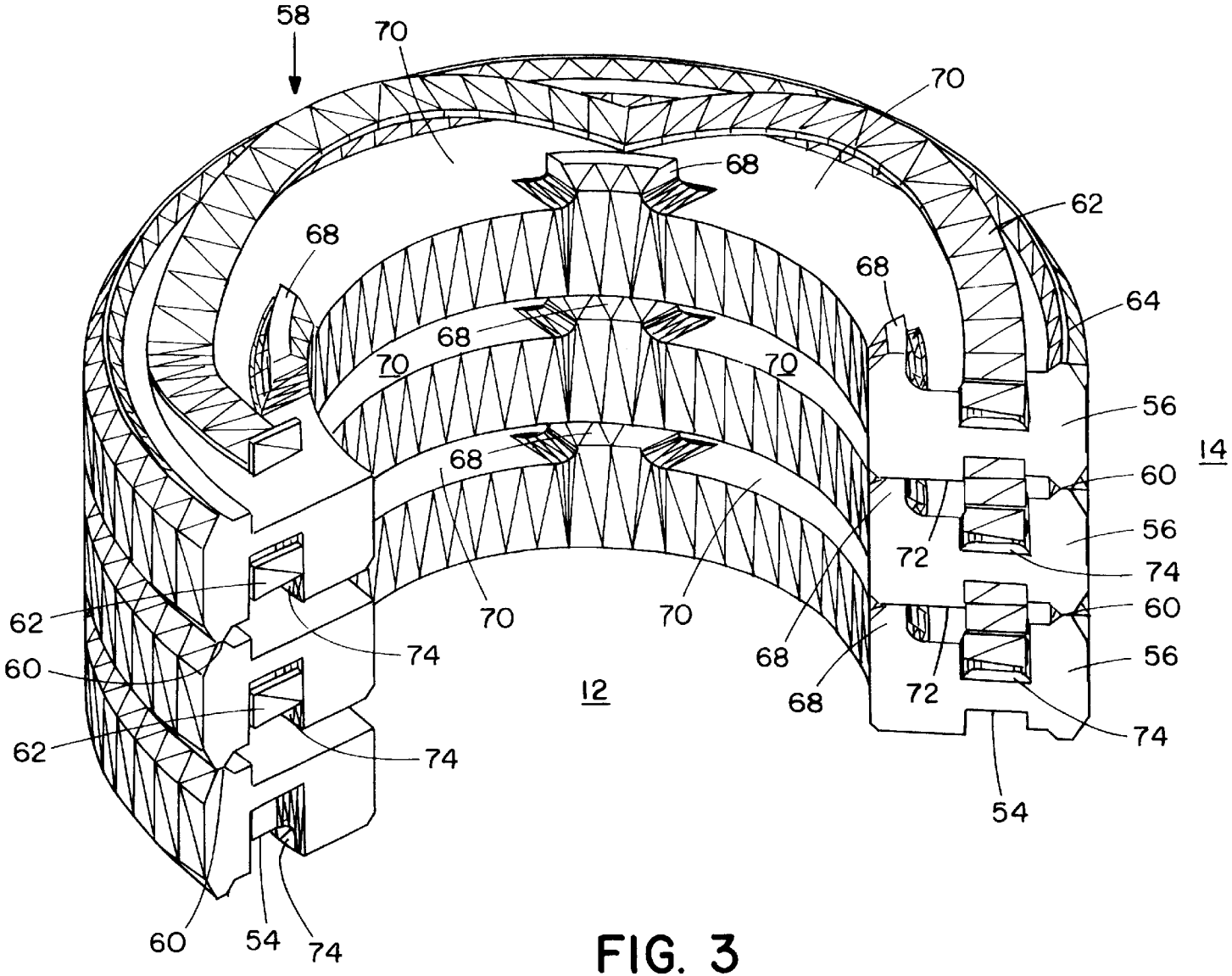
FIG. 3 is a cross sectional isometric view of the preferred valve members of the present invention also shown in FIG. 1.
Figure 4:
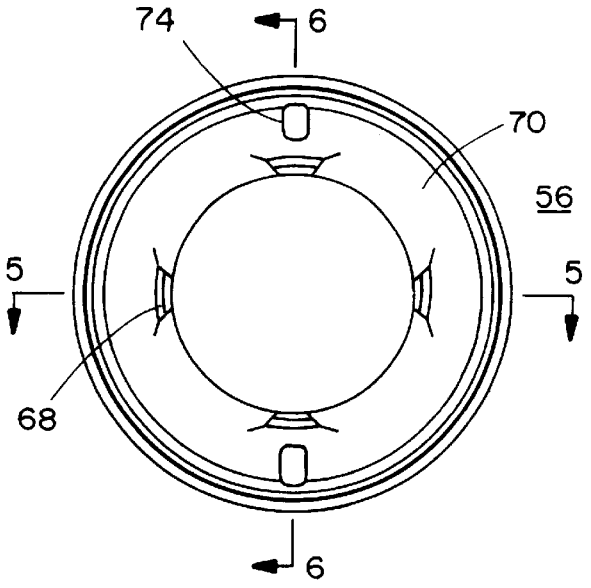
FIG. 4 is a plan view of an exemplary valve member with spacer pads in accordance with the present invention.

The inventive valve members 56 of the present invention also form a stack of valve members 58 as illustrated on the right side of the valve of FIG. 1 and FIG. 3. Generally, as will be described below, the valve members 58 provide improved efficiency and reduced chattering of the stack due to the layout of the valve members. Beneficially, these valve members 58 are configured to be retrofitted within existing assemblies 2.

As illustrated, the valve gaps 60 and valve springs 62 are provided between each valve member pair. The gaps 60 provided between each valve member pair form a restricted passageway through which the emulsion or dispersion is expressed to the low pressure chamber 65. The gaps 60 can be formed as illustrated in FIG. 3 of the '769 patent. Preferably, the gaps 60 are formed as disclosed in commonly assigned U.S. Pat. No. 5,749,650, filed Mar. 13, 1997, and U.S. Pat. No. 5,899,564 filed May 11, 1998, the contents of both patents being incorporated herein in their entirety by this reference.

More specifically, the height of the gap 60 is preferably between 0.0013 and 0.0018 inches, usually about 0.0015 inches, but in any event less than 0.003 inches. This dimension is defined as the vertical distance between the valve seat or land and the opposed, largely flat, valve surface on opposite faces of the valve member. Experimentation has shown that the gap should not be simply increased beyond 0.003 inches to obtain higher flow rates since such increases will lead to lower homogenization efficiencies.

Figure 5:
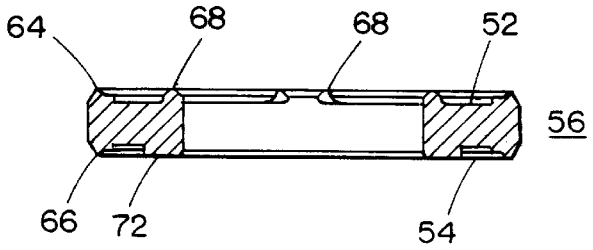
FIG. 5 is a cross sectional view taken along line 5—5 of FIG. 4.
Figure 6:
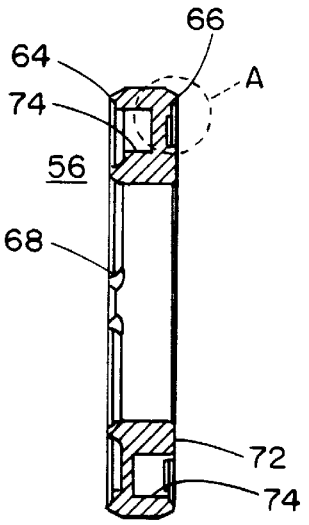
FIG. 6 is a cross sectional view taken along line 6—6 of FIG. 4.
Figure 7:
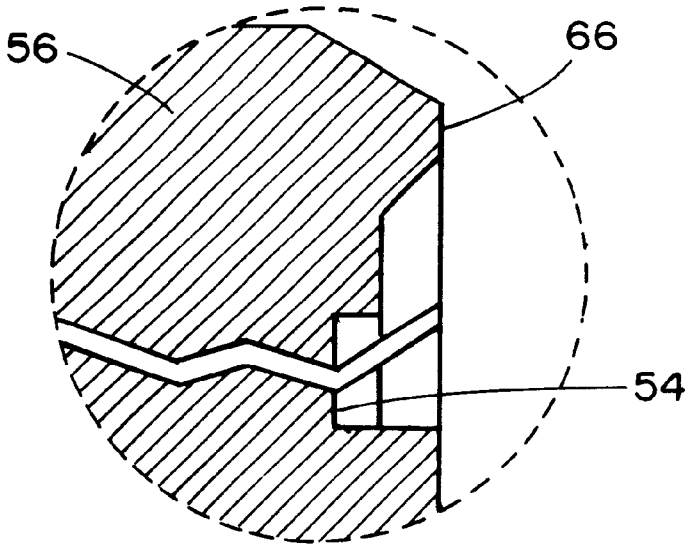
FIG. 7 is an enlarged view of the encircled area referenced as "A" of FIG. 6.

In the preferred embodiment, the valve seat is a knife-edge configuration. With reference to FIGS. 5–7, on the upstream, high pressure side of the gap, the valve seat or land 64 is chamfered at 60° angle sloping toward the valve surface 66. In the gap, the valve seat 64 is flat across a distance of ideally approximately 0.015 to 0.020 inches, but less than 0.06 inches. On the downstream, low pressure side of the gap 60, the valve seat 64 slopes away from the valve surface 66 at an angle from 5 to 90° or greater, approximately 60° in the illustrated embodiment. The valve surface 66 is similarly constructed. The downstream terminations of valve surfaces overlap valve seats or lands by no more than 0.025 inches. Preferably, the downstream terminations of the valve surfaces 66 overlap the valve seats 64 by at least a height of the valve gaps 60. It has also been found that no overlap between the valve seats 64 and valve surfaces 66 can be effective as well.

It is significant that the valve springs 62 are positioned upstream from the valve gaps 60, i.e., on the high pressure side of the valve gaps. Prior art designs have expressed the fluid into a closed environment between the valve members. In the present invention, however, the high pressure fluid passes through the spring region before being expressed through the valve gaps 60. Accordingly, the turbulent expressed fluid is in the open chamber 64 and not over the springs, an arrangement which has been found to reduce chatter of the valve members 56. Chattering of the valve members 56 is undesirable as such can damage the valve members, emit noise, and produce other deleterious effects in the operation of the valve 2.

It should also be noted that the distance from the center of the high pressure chamber 12 to the valve gaps 16, 60 is substantially the same such that the prior art valve members 4 can be replaced by the inventive valve members 56 without any or only minor adjustment to the actuator pressure required to adjust the valve gaps.

The inventive valve members 56 include spacing elements or pads which allow the valve members to be compressed by the actuator 34 such that substantially all the valve gaps 60 are adjusted to compensate for wear. This has the advantage of maintaining a separational distance (and often optimized) between the valve seat and valve surface for a preferred pressure despite wear which tends to widen the gaps.

FIGS. 3–6 illustrate exemplary spacer pads 68 that form part of valve member 56. Area 70 is machined off leaving the spacer pads 68. Valve members 56 are stacked on one another with spacer pads 68 of one valve member contacting the underside 72 of a contiguous valve member to form the valve gaps 60 between the valve seat 64 and opposing valve surface 66. Alternatively, spacers pads 68 can be a separate element coupled to or positioned adjacent the valve members 56. The spacer pads 68 are small enough such that they can be compressed by the actuator 34. In a preferred embodiment of the present invention, each spacer pad 68 has a surface area of approximately 11 $mm^2$ that touches the underside 72 of a contiguous valve member 56 when assembled. This allows each spacer pad 68 to be compressed up to about 0.002 inches (0.0508 mm).

In alternative embodiments, the spacer element can comprise a continuous, relatively thin, annular lip which is compressed to compensate for wear of the valve surfaces and seats.

The valve springs 62 help align the stack formation as before. Additionally, the valve spring 62 ends can be bent, for example, 90 degrees, and inserted into machined notches or pockets 74 (see FIGS. 3, 4 and 6) in adjacent valve members such that the stack of valve members maintains preferable angular alignment. Such a configuration prevents rotation of the valve members 56 relative to one another. That is to say, the spacer pads 68 are aligned in vertical rows when preferably aligned.

Returning to FIG. 1, the base valve member 76 is an improvement over the prior art base valve member 26. More particularly, the member 76 is similar to the other valve members 56 except that there is no machining on the bottom surface. Thus, an expensive part to machine is beneficially avoided. A valve guide 78 sealed against the housing 28 via o-ring 30 and against the base valve member 76 via gasket 80 is provided to center the base valve member and hence the stack 58 of valve members. Preferably, the valve guide 78 is formed from a less expensive material, such as stainless steel, thereby saving material cost over the prior art base valve member 26.

Figure 8:
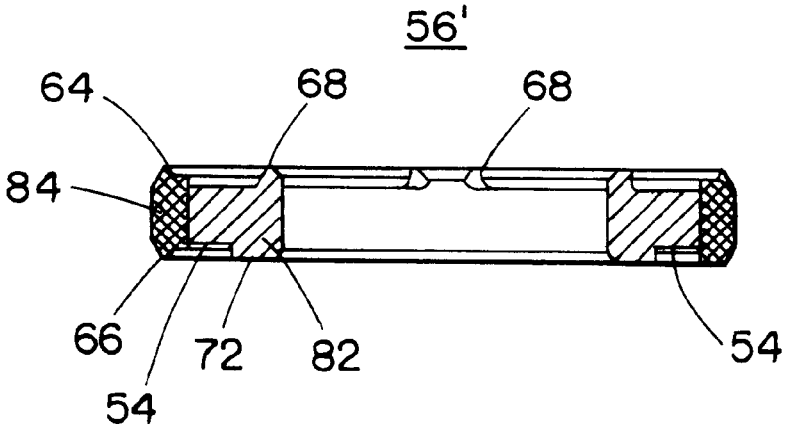
FIG. 8 is a cross sectional view of an alternative valve member.

FIG. 8 illustrates an alternative embodiment of the valve member, designated by reference numeral 56'. This valve member 56' illustrates the spacer pads 68 adjacent the high pressure volume 12 and the valve seat 64 and valve surface 66 adjacent the low pressure volume 65. The valve member 56' is formed from at least two materials: a hard, durable material forming the valve seat and surface to minimize wear thereof and a relatively soft, compressible material forming the spacer pads to allow compression without cracking thereof. Preferably, an inner ring 82 of a relatively soft material, such as stainless steel, is inserted into an outer ring 84 of a harder, more durable material, such as tungsten-carbide. In a preferred embodiment, the hard material has a Rockwell A-scale hardness number of greater than 90 and the compressible material has a Rockwell A-scale hardness number of not greater than 80. The rings 82, 84 are maintained in position by an interference fit or other suitable methods, such as welding.

It will be understood that the inventive concepts discussed supra can be applied to other homogenizing valve configurations, such as disclosed in U.S. application Ser. No. 09/350,503 entitled "HOMOGENIZATION VALVE WITH OUTSIDE HIGH PRESSURE VOLUME". More particularly, fluid can be expressed from an outside high pressure volume outside the stacked valve members to a low pressure volume inside the valve members. In that case, preferably the springs are configured to be within the high pressure volume and the spacing elements are adjacent the low pressure volume.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A valve member for a stacked valve member homogenizing valve, the valve member including a valve seat to define a gap with an opposed valve surface, the valve member including a plurality of circumferentially spaced, deformable spacing elements that deform to control the gap.

2. The valve member of claim 1, wherein the valve member includes opposite faces, the first face including the valve seat and the second face including the valve surface to define respective valve gaps when valve members are stacked on one another.

3. The valve member of claim 2, further comprising an actuator that adjusts the width of substantially all of the gaps by deforming the spacing elements.

4. The valve member of claim 1, further comprising a groove for containing a spring.

5. The valve member of claim 4, further comprising annular springs that align adjoining pairs of valve members, the springs positioned within grooves in the valve members.

6. The valve member of claim 5, wherein each spring has a first end and a second end, each end being bent at an angle and positioned in notches of adjacent valve members to maintain angular alignment of the valve members.

7. The valve member of claim 1, wherein the spacing elements are integral to the valve member.

8. The valve member of claim 7, wherein each valve member includes four spacing elements.

9. The valve member of claim 1, wherein the spacing elements are formed from a first material and the valve surface and valve seat are formed from a second material.

10. The valve member of claim 9, wherein the first material is stainless steel and the second material is tungsten-carbide.

11. The valve member of claim 9, wherein the first material has a Rockwell A-scale hardness number of not greater than 80 and the second material has a Rockwell-A scale hardness number greater than 90.

12. A homogenizing valve, comprising:

a housing;

a plurality of valve members within the housing having valve seats defining gaps with valve surfaces when stacked on one another, each valve member including a plurality of circumferentially spaced, deformable spacing elements to maintain the gaps; and an actuator which acts on the valve members to deform the spacing elements to control the width of the gaps.

13. The homogenizing valve of claim 12, wherein each valve member includes opposite faces, the first face including the valve seat and the second face including the valve surface to define respective valve gaps when valve members are stacked on one another.

14. The homogenizing valve of claim 12, wherein the acuator adjusts the width of substantially all of the gaps by deforming the spacing elements.

15. The homogenizing valve of claim 12, wherein the spacing elements are integral to the valve members.

16. The homogenizing valve of claim 12, wherein each valve member includes four spacing elements.

17. The homogenizing valve of claim 12, wherein the spacing elements are formed from a first material and the valve surfaces and valve seats are formed from a second material.

18. The homogenizing valve of claim 17, wherein the first material is stainless steel and the second material is tungsten-carbide.

19. The homogenizing valve of claim 17, wherein the first material has a Rockwell A-scale hardness number of not greater than 80 and the second material has a Rockwell-A scale hardness number greater than 90.

20. The homogenizing valve of claim 19, further comprising annular springs that align adjoining pairs of valve members, the springs positioned within springgrooves in the valve members.

21. The homogenizing valve of claim 20, wherein fluid to be homogenized is expressed through the gaps radially from an inside high pressure volume to an outer low pressure volume, the springs being positioned in the high pressure volume.

22. The homogenizing valve of claim 20, wherein each spring has a first end and a second end, each end being bent at an angle and positioned in notches of adjacent valve members to maintain angular alignment of the valve members.

23. A homogenizing valve, comprising:

a housing;

a plurality of valve members within the housing having valve seats defining gaps with valve surfaces when stacked on one another;

deformable spacing means for maintaining the gaps; and an actuator which acts on the valve members to control the width of the gaps.

24. A method of homogenizing a fluid with stacked valve members, comprising:

expressing a fluid through a plurality of gaps from a high pressure volume to a low pressure volume; and deforming spacing elements between the valve members with an actuator to control the width of substantially all of the gaps.

25. The method of claim 24, wherein the spacing elements are integral to the valve members.

26. The method of claim 24, further comprising circumferentially spaced spacing elements.

27. The method of claim 24, further comprising annular springs for aligning adjoining pairs of valve members, the springs being positioned within spring-grooves in the valve members in the high pressure volume.

28. The method of claim 24, wherein each spring has a first end and a second end, further comprising the step of bending each end at an angle and positioning each end in notches of adjacent valve members to maintain angular alignment of the valve members.

29. A homogenizing valve for homogenizing a fluid, comprising:

a housing;

a plurality of valve members within the housing having valve seats defining gaps with valve surfaces when stacked on one another, fluid to be homogenized being expressed through the gaps radially from an inside high pressure volume to an outer low pressure volume; and annular springs that align adjoining pairs of valve members, the springs positioned within spring-grooves in the valve members, the springs being to the high pressure volume.

30. The homogenizing valve of claim 29, wherein each valve member includes a plurality of circumferentially spaced, compressible spacing elements to maintain the gaps.

31. The homogenizing valve of claim 30, wherein the spacing elements are formed from a first material and the valve surfaces and valve seats are formed from a second material.

32. The homogenizing valve of claim 31, wherein the first material is stainless steel and the second material is tungsten-carbide.

33. The homogenizing valve of claim 31, wherein the first material has a Rockwell A-scale hardness number of not greater than 80 and the second material has a Rockwell-A scale hardness number greater than 90.

34. The homogenizing valve of claim 31, further comprising an actuator that adjusts the width of substantially all of the gaps by compressing the spacing elements.

35. The homogenizing valve of claim 31, wherein the spacing elements are integral to the valve members.

36. The homogenizing valve of claim 31, wherein each valve member includes four spacing elements.

37. The homogenizing valve of claim 29, wherein each spring has a first end and a second end, each end being bent at an angle and positioned in notches of adjacent valve members to maintain angular alignment of the valve members.

38. The homogenizing valve of claim 29, wherein each valve member includes opposite faces, the first face including the valve seat and the second face including the valve surface to define respective valve gaps when valve members are stacked on one another.

39. A homogenizing valve for homogenizing a fluid, comprising:

a housing;

a plurality of valve members within the housing having valve seats defining gaps with valve surfaces when stacked on one another, fluid to be homogenized being expressed through the gaps radially from an inside high pressure volume to an outer low pressure volume; and means for aligning adjoining pairs of valve members positioned within the valve members and being to the high pressure volume.

40. A method of homogenizing a fluid with stacked valve members, comprising expressing a fluid through a plurality of gaps from a high pressure volume to a low pressure volume to homogenize the fluid, the valve members being aligned with annular springs, the springs being positioned within spring-grooves in the high pressure volume.

41. The method of claim 40, wherein each spring has a first end and a second end, further comprising the step of bending each end at an angle and positioning each end in notches of adjacent valve members to maintain angular alignment of the valve members.

42. The method of claim 40, further comprising the step of compressing spacing elements between the valve members with an actuator to control the width of substantially all of the gaps.

43. The method of claim 42, wherein the spacing elements are integral to the valve members.

44. The method of claim 42, further comprising circumferentially spaced spacing elements.

45. A valve member for a homogenizing valve, the valve member including a valve seat to define a gap with an opposed valve surface, the valve member including a deformable spacing element that deforms to maintain the gap, wherein the spacing element is formed from a first material and the valve surface and valve seat are formed from a second material.

46. The valve member of claim 45, wherein the first material is stainless steel and the second material is tungsten-carbide.

47. The valve member of claim 45, wherein the first material has a Rockwell A-scale hardness number of not greater than 80 and the second material has a Rockwell-A scale hardness number greater than 90.

48. The valve member of claim 45, further comprising a plurality of circumferentially spaced, deformable spacing elements that deform to maintain the gap.

49. The valve member of claim 48, wherein the spacing elements are integral to the valve member.

50. The valve member of claim 48, wherein each valve member includes four spacing elements.

51. The valve member of claim 45, wherein the valve member includes opposite faces, the first including the valve seat and the second face including the valve surface to define respective valve gaps when valve members are stacked on one another.

52. The valve member of claim 48, further comprising an actuator that adjusts the width of substantially all of the gaps by deforming the spacing elements.

53. The valve member of claim 45, further comprising a groove for containing a spring.

54. The valve member of claim 53, further comprising annular springs that align adjoining pairs of valve members, the springs positioned within grooves in the valve members.

55. The valve member of claim 54, wherein each spring has a first end and a second end, each end being bent at an angle and positioned in notches of adjacent valve members to maintain angular alignment of the valve members.

56. A homogenizing valve, comprising:

a housing;

a plurality of valve members within the housing having valve seats defining gaps with valve surfaces when stacked on one another;

a deformable spacing element between each valve member that deforms to maintain the gaps, wherein the spacing elements are formed from a first material and the valve seats and valve surfaces are formed from a second material; and an actuator which acts on the valve members to deform the same to control the width of the gaps.

57. The homogenizing valve of claim 56, wherein the first material is stainless steel and the second material is tungsten-carbide.

58. The homogenizing valve of claim 56, wherein the first material has a Rockwell A-scale hardness number of not greater than 80 and the second material has a Rockwell-A scale hardness number greater than 90.

59. The valve member of claim 56, further comprising a plurality of circumferentially spaced, deformable spacing elements to maintain the gaps.

60. The homogenizing valve of claim 59, wherein the actuator adjusts the width of substantially all of the gaps by deforming the spacing elements.

61. The homogenizing valve of claim 59, wherein the spacing elements are integral to the valve members.

62. The homogenizing valve of claim 61, wherein each valve member includes four spacing elements.

63. The homogenizing valve of claim 56, wherein each valve member includes opposite faces, the first face including the valve seat and the second face including the valve surface to define respective valve gaps when valve members are stacked on one another.

64. The homogenizing valve of claim 56, further comprising annular springs that align adjoining pairs of valve members, the springs positioned within springgrooves in the valve members.

65. The homogenizing valve of claim 64, wherein fluid to be homogenized is expressed through the gaps radially from an inside high pressure volume to an outer low pressure volume, the springs being positioned in the high pressure volume.

66. The homogenizing valve of claim 64, wherein each spring has a first end and a second end, each end being bent at an angle and positioned in notches of adjacent valve members to maintain angular alignment of the valve members.

67. A homogenizing valve, comprising:

a housing;

a plurality of valve members within the housing having valve seats defining gaps with valve surfaces when stacked on one another;

means for spacing each valve member to maintain the gaps, wherein the spacing means is formed from a first material and the valve seats and valve surfaces are formed from a second material; and an actuator which acts on the valve members to deform the first material to control the width of the gaps.

68. A method of forming a valve member for a stacked valve member homogenizing valve, comprising:

forming a valve seat and a valve surface from a first material; and forming an integral spacing element on the valve member from a second material.

69. The method of claim 68, wherein the first material is tungsten-carbide and the second material is stainless steel.

70. The method of claim 68, wherein the first material has a Rockwell A-scale hardness number of not greater than 80 and the second material has a Rockwell-A scale hardness number greater than 90.

71. The method of claim 68, further comprising the steps of:

providing a single continuous valve member; and removing portions of each valve member to form integral spacing elements.

72. The method of claim 68, further comprising the steps of:

providing a single continuous valve member; and removing portions of each valve member to form circumferentially spaced, compressible spacing elements.

73. The method of claim 68, further comprising the step of aligning adjoining pairs of valve members with annular springs, the springs being positioned within spring-grooves in the valve members in a high pressure volume.

74. The method of claim 73, wherein each spring has a first end and a second end, further comprising the step of bending each end at an angle and positioning each end in notches of adjacent valve members to maintain angular alignment of the valve members.

* * * * *